US012553115B2

(12) United States Patent
Shibata et al.

(10) Patent No.: US 12,553,115 B2
(45) Date of Patent: Feb. 17, 2026

(54) STAINLESS STEEL WITH GOOD MIRROR POLISHABILITY AND METHOD FOR PRODUCING SAME

(71) Applicant: NIPPON STEEL Stainless Steel Corporation, Tokyo (JP)

(72) Inventors: Tooru Shibata, Tokyo (JP); Yuto Sakaizawa, Tokyo (JP); Shigeo Fukumoto, Tokyo (JP); Akira Tanaka, Tokyo (JP); Shin Kikuchi, Tokyo (JP)

(73) Assignee: NIPPON STEEL Stainless Steel Corporation, Tokyo (JP)

( * ) Notice: Subject to any disclaimer, the term of this patent is extended or adjusted under 35 U.S.C. 154(b) by 691 days.

(21) Appl. No.: 17/800,971

(22) PCT Filed: Feb. 24, 2021

(86) PCT No.: PCT/JP2021/006919

§ 371 (c)(1),
(2) Date: Aug. 19, 2022

(87) PCT Pub. No.: WO2021/172376

PCT Pub. Date: Sep. 2, 2021

(65) Prior Publication Data

US 2023/0115048 A1 Apr. 13, 2023

(30) Foreign Application Priority Data

Feb. 27, 2020 (JP) ..... 2020-032106

(51) Int. Cl.

| | |
|---|---|
| ***C22C 38/58*** | (2006.01) |
| ***C21D 3/04*** | (2006.01) |
| ***C22C 33/06*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/58* (2013.01); *C21D 3/04* (2013.01); *C22C 33/06* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search
None
See application file for complete search history.

(56) References Cited

U.S. PATENT DOCUMENTS

| | | | |
|---|---|---|---|
| 6,123,784 | A | 9/2000 | Havette |
| 6,187,452 | B1 | 2/2001 | Muto et al. |
| 9,303,301 | B2 | 4/2016 | Todoroki |
| 10,400,317 | B2 | 9/2019 | Todoroki et al. |
| 11,118,250 | B2 | 9/2021 | Mizuno et al. |
| 2014/0023549 | A1 | 1/2014 | Katsuki |
| 2014/0205486 | A1 | 7/2014 | Todoroki |
| 2017/0058384 | A1 | 3/2017 | Todoroki et al. |
| 2017/0283917 | A1 | 10/2017 | Katsuki |
| 2018/0272397 | A1 | 9/2018 | Ehara et al. |
| 2020/0347488 | A1 | 11/2020 | Mizuno et al. |

FOREIGN PATENT DOCUMENTS

| | | | |
|---|---|---|---|
| AU | 2004/262702 | B2 | 2/2005 |
| CN | 1701126 | A | 11/2005 |
| CN | 103748249 | A | 4/2014 |

(Continued)

OTHER PUBLICATIONS

English language machine translation of JP-2001011581-A. Generated Mar. 28, 2025. (Year: 2025).*
English language machine translation of JP-2015074807-A. Generated Jun. 14, 2025. (Year: 2025).*
Office Action issued in Korean Patent Application No. 10-2022-7027733 dated Apr. 26, 2024 (including English translation).
Notice of Decision of Grant issued in CN Application No. 202180013746.4 dated May 29, 2023 (with English translation).
International Search Report issued in International Application No. PCT/JP2021/006919 dated May 18, 2021 (with English translation).
Extended European Search Report issued in counterpart European Patent Application No. 21760834.8 dated May 22, 2025.

*Primary Examiner* — Brian D Walck
(74) *Attorney, Agent, or Firm* — TROUTMAN PEPPER LOCKE LLP

(57) ABSTRACT

The stainless steel contains 0.0001 mass % or more and 0.15 mass % or less of C, 0.30 mass % or more and 2.0 mass % or less of Si, 0.1 mass % or more and 15 mass % or less of Mn, 5 mass % or more and 30 mass % or less of Ni, 0.0001 mass % or more and 0.01 mass % or less of S, 16 mass % or more and 25 mass % or less of Cr, 0 mass % or more and 5 mass % or less of Mo, 0 mass % or more and 0.005 mass % or less of Al, 0 mass % or more and 0.0010 mass % or less of Mg, 0.0010 mass % or more and 0.0060 mass % or less of O, and 0.0001 mass % or more and 0.5 mass % or less of N, and at least includes an inclusion with an equivalent circle diameter of 5 μm or more, having the average composition of 5 mass % or more of MnO, 20 mass % or more of $Cr_2O_3$+$Al_2O_3$, 1 mass % or more of $Al_2O_3$, and 5 mass % or less of CaO. The number density of the inclusion having the composition is 0.5 inclusions/$mm^2$ or less.

8 Claims, No Drawings

(56) References Cited

FOREIGN PATENT DOCUMENTS

| | | | | |
|---|---|---|---|---|
| CN | 106480379 | A | | 3/2017 |
| CN | 108368573 | A | | 8/2018 |
| EP | 2749669 | A1 | | 7/2014 |
| EP | 3 524 704 | A1 | | 8/2019 |
| JP | H03-61322 | A | | 3/1991 |
| JP | 2000001715 | A | | 1/2000 |
| JP | 2001011581 | A | * | 1/2001 |
| JP | 3416858 | B2 | | 3/2003 |
| JP | 2004-149830 | A | | 5/2004 |
| JP | 2005-290449 | A | | 10/2005 |
| JP | 2007-277727 | A | | 10/2007 |
| JP | 2012201945 | A | | 10/2012 |
| JP | 2014-162948 | A | | 9/2014 |
| JP | 2015074807 | A | * | 4/2015 |
| JP | 2016-089263 | A | | 5/2016 |
| JP | 2016191124 | A | | 11/2016 |
| JP | 6146908 | B2 | | 6/2017 |
| JP | 2018-150606 | A | | 9/2018 |
| JP | 2018172709 | A | | 11/2018 |
| JP | 2019035124 | A | | 3/2019 |
| WO | 2018066182 | A1 | | 4/2018 |

* cited by examiner

STAINLESS STEEL WITH GOOD MIRROR POLISHABILITY AND METHOD FOR PRODUCING SAME

CROSS REFERENCES TO RELATED APPLICATIONS

The present application is a U.S. National Phase Application under 35 U.S.C. § 371 of International Patent Application No. PCT/JP2021/006919, filed Feb. 24, 2021, which claims priority of Japanese Patent Application No. 2020-032106, filed Feb. 27, 2020. The entire contents of which are hereby incorporated by reference.

TECHNICAL FIELD

The present invention relates to a stainless steel with good mirror polishability and a method for producing the same.

BACKGROUND

Conventionally, methods for producing an ultra-clean stainless are classified roughly into two methods: a method using a special melting/remelting method, and a method using a versatile refining method.

The method using a special melting/remelting method is a production method which can achieve high cleanliness but has extremely low productivity, and has high production costs, and is thus not suitable for mass production. Therefore, a versatile refining method is commonly used. However, mass production can be achieved by a versatile refining method at relatively lower costs, but it is not technically easy to obtain high cleanliness.

Therefore, it has been desired to achieve high cleanliness while using a versatile refining method.

JP 3416858, for example, describes a method for suppressing flaws caused by $Al_2O_3$ inclusions by setting basicity at 1.0 to 1.5 and the concentration of $Al_2O_3$ in a slag at 10% or less in a refining step.

In addition, JP 6146908 describes a method for suppressing $MgO \cdot Al_2O_3$ by setting basicity at less than 2 to 5 and reducing the concentration of $Al_2O_3$ in a slag in a refining step.

SUMMARY

In the method in JP 3416858, however, there is a risk that large and hard $MgO \cdot Al_2O_3$ inclusions with an equivalent circle diameter of 5 μm or more including $Al_2O_3$ will be generated because the upper limit of the $Al_2O_3$ concentration in a slag is high. When the inclusions are generated, because they are not extended by a rolling step, they are not observed as macro-streak flaw. Therefore, the problem in JP 3416858 is not a matter. However, there is a risk that as a material which is mirror-polished by e.g. customers, the inclusions will have a negative effect on polishability and a stainless steel will not have a clean mirror surface.

In addition, a steel with a high O concentration may be produced in the method in JP 6146908, and there is a risk that large and hard $MnO \cdot Al_2O_3 \cdot Cr_2O_3$ inclusions with an equivalent circle diameter of 5 μm or more will be generated. When the inclusions are generated, there is a risk that as a material which is mirror-polished by e.g. customers, the inclusions will have a negative effect on polishability, and a stainless steel will not have a clean mirror surface.

As described above, hard inclusions mainly including $MgO \cdot Al_2O_3$ and $MnO \cdot Al_2O_3 \cdot Cr_2O_3$ exist in a stainless steel produced using a versatile refining method. These hard inclusions are not easily cut and finely divided by e.g. rolling, and have a different behavior from a base material when being polished due to differences in hardness from the base material at the time of polishing. There is thus a risk that the inclusions will have a negative effect on polishability and a stainless steel will not have a clean mirror surface. Therefore, a stainless steel having high specularity after being polished has been desired.

The present invention has been made in view of such points, and an object thereof is to provide a stainless steel with good mirror polishability and a method for producing the same.

The stainless steel with good mirror polishability contains C: 0.0001 mass % or more and 0.15 mass % or less, Si: 0.30 mass % or more and 2.0 mass % or less, Mn: 0.1 mass % or more and 15 mass % or less, Ni: 5 mass % or more and 30 mass % or less, S: 0.0001 mass % or more and 0.01 mass % or less, Cr: 16 mass % or more and 25 mass % or less, Mo: 0 mass % or more and 5 mass % or less, Al: 0 mass % or more and 0.005 mass % or less, Mg: 0 mass % or more and 0.0010 mass % or less, O: 0.0010 mass % or more and 0.0060 mass % or less, N: 0.0001 mass % or more and 0.5 mass % or less, and the remainder including Fe and inevitable impurities, and at least includes one inclusion with an equivalent circle diameter of 5 μm or more, having the average composition of MnO: 5 mass % or more, $Cr_2O_3$+$Al_2O_3$: 20 mass % or more, $Al_2O_3$: 1 mass % or more, and CaO: 5 mass % or less, wherein the number density of the one inclusion is 0.5 inclusions/$mm^2$ or less.

The stainless steel with good mirror polishability further includes another inclusion with an equivalent circle diameter of 5 μm or more, having the average composition of MgO: 10 mass % or more and $Al_2O_3$: 20 mass % or more, in the stainless steel with good mirror polishability according to claim 1, wherein the number density of one inclusion is 0.5 inclusions/$mm^2$ or less, the number density of the another inclusion is 0.2 inclusions/$mm^2$ or less, and the number density of the sum of the one inclusion and another inclusion is 0.5 inclusions/$mm^2$ or less.

The stainless steel with good mirror polishability further contains at least any one of Cu: 0.1 mass % or more and 4.0 mass % or less, REM: 0.00001 mass % or more and 0.0030 mass % or less, Ca: 0.0001 mass % or more and 0.0050 mass % or less, B: 0.0001 mass % or more and 0.0050 mass % or less, Ti: 0.01 mass % or more and 0.50 mass % or less, Nb: 0.01 mass % or more and 0.50 mass % or less, V: 0.01 mass % or more and 1.00 mass % or less, W: 0.01 mass % or more and 1.00 mass % or less, Co: 0.01 mass % or more and 1.00 mass % or less, and Sn: 0.01 mass % or more and 1.00 mass % or less in the stainless steel with good mirror polishability according to the above.

The method for producing a stainless steel with good mirror polishability according to the above, the method including a refining step of performing refining in VOD or AOD, wherein slag composition is, in mass % ratio, CaO/$SiO_2$: 1.1 or more and 1.7 or less, $Al_2O_3$: 4.0 mass % or less, and MgO: 10.0 mass % or less by, in the refining step, adjusting the amount of Al and the amount of $Al_2O_3$ contained in a raw material or a ladle, performing deoxidation using a Fe—Si alloy or metal Si, and also adding CaO or $SiO_2$, and moreover molten steel is stirred at a stirring power of 50 W/ton or more for 5 minutes or more after adding a refining slag material and an alloy material.

According to the present invention, defects such as pits and pin holes caused by inclusions at the time of polishing can be suppressed, and mirror polishability is good.

DETAILED DESCRIPTION

One embodiment of the present invention will now be described.

The stainless steel of the present embodiment is an austenitic stainless steel, which contains 0.0001 mass % or more and 0.15 mass % or less of C (carbon), 0.30 mass % or more and 2.0 mass % or less of Si (silicon), 0.1 mass % or more and 15 mass % or less of Mn (manganese), 5 mass % or more and 30 mass % or less of Ni (nickel), 0.0001 mass % or more and 0.01 mass % or less of S (sulfur), 16 mass % or more and 25 mass % or less of Cr (chromium), 0 mass % or more and 5 mass % or less of Mo (molybdenum), 0 mass % or more and 0.005 mass % or less of Al (aluminum), 0 mass % or more and 0.0010 mass % or less of Mg (magnesium), 0.0010 mass % or more and 0.0060 mass % or less of O (oxygen), 0.0001 mass % or more and 0.5 mass % or less of N (nitrogen), and the remainder including Fe (iron) and inevitable impurities. It should be noted that the stainless steel may further contain, in addition to the above, 0.1 mass % or more and 4.0 mass % or less of Cu (copper), and/or 0.00001 mass % or more and 0.0030 mass % or less of REM (rare-earth metal) as needed. The stainless steel may also contain Ca (calcium). The stainless steel may further contain predetermined amounts of elements such as P (phosphorus), Sn (tin), Nb (niobium), Ti (titanium), Co (cobalt), V (vanadium), W (tungsten), and B (boron).

In addition, the stainless steel of the present embodiment is produced as a steel sheet with a sheet thickness of 0.3 mm to 10 mm or wire (steel wire, stainless wire) with a diameter of 4.0 mm to 40 mm after predetermined production steps described below.

In the stainless steel of the present embodiment, the number density of hard inclusions with a large equivalent circle diameter is suppressed to obtain good mirror polishability. The equivalent circle diameter means the diameter of a circle equal to the area of an inclusion. Specifically, the stainless steel of the present embodiment at least includes one inclusion with an equivalent circle diameter of 5 μm or more, having the average composition of, in mass percentage, MnO: 5 mass % or more, $Cr_2O_3$+$Al_2O_3$: 20 mass % or more, $Al_2O_3$: 1 mass % or more, and CaO: 5 mass % or less (hereinafter referred to as first inclusion). The stainless steel of the present embodiment further includes another inclusion with an equivalent circle diameter of 5 μm or more, having the average composition of MgO: 10 mass % or more and $Al_2O_3$: 20 mass % or more (hereinafter referred to as second inclusion). Furthermore, about the number of inclusions obtained by measuring an optional cross section, the number density of the first inclusion is adjusted to 0.5 inclusions/$mm^2$ or less in the stainless steel of the present embodiment. In addition, about the number of inclusions obtained by measuring an optional cross section, the number density of the second inclusion is adjusted to 0.2 inclusions/$mm^2$ or less, and the number density of the sum of the first inclusion and the second inclusion is adjusted to 0.5 inclusions/$mm^2$ or less in the stainless steel of the present embodiment. The first inclusion and the second inclusion are hard inclusions which are not easily cut and finely divided even by e.g. rolling a stainless steel. When a stainless steel in the state of slab is rolled, the surface area increases, while inclusions contained in the inside are exposed on the surface. Therefore, the number of the first inclusion and the second inclusion per unit area is basically constant even in the state of slab or the state of being rolled to a steel sheet or wire (steel wire, stainless wire).

C is an austenite stabilizing element, and the hardness and strength of a stainless steel increase by containing C. In contrast, when C is excessively contained, it reacts with Cr or Mn in a base material to deteriorate corrosion resistance. Therefore, the C content is 0.0001 mass % or more and 0.15 mass % or less, and preferably 0.1 mass % or less.

Si is an essential element for deoxidation under low Al conditions. When the Si content is lower than 0.30 mass %, the $Cr_2O_3$ percentage content in inclusions increases. Therefore, hard inclusions increase, which has a negative effect on polishability. In addition, when the Si content is higher than 2.0 mass %, the base material of a stainless steel becomes hard. Therefore, the Si content is 0.30 mass % or more and 2.0 mass % or less, and preferably 0.50 mass % or more and 1.0 mass % or less.

Mn is an effective element for deoxidation, and also an austenite stabilizing element. When the Mn content is lower than 0.1 mass %, the $Cr_2O_3$ percentage content in inclusions increases. Therefore, hard inclusions increase, which has a negative effect on polishability. Therefore, the Mn content is 0.1 mass % or more, and preferably 0.5 mass % or more and 15 mass % or less.

Ni is an element which enhances the corrosion resistance of a stainless steel, and also an austenite stabilizing element. The Ni content is 5 mass % or more and 30 mass % or less.

S is an element which enhances melting characteristics when welding a stainless steel. However, when the S content is higher than 0.01 mass %, a sulfide-based inclusion is generated, which has a negative effect on the polishability of a stainless steel and also reduces corrosion resistance. Therefore, the S content is 0.0001 mass % or more and 0.01 mass % or less, and preferably 0.005 mass % or less.

Cr is an essential element to secure the corrosion resistance of a stainless steel. However, when the Cr content is higher than 25 mass %, the production of a stainless steel becomes difficult, and the $Cr_2O_3$ percentage content in inclusions increases, and thus the stainless steel becomes hard. Therefore, the Cr content is 16 mass % or more and 25 mass % or less.

Cu is an element which enhances the workability of a stainless steel, and also an austenite stabilizing element. A case where the Cu content is higher than 4.0 mass % has a negative effect on manufacturability due to hot shortness. In addition, Cu is a selective element, and a case where Cu is not added is also included. Therefore, the Cu content is 0 mass % or more and 4.0 mass % or less, and, when Cu is contained, 0.1 mass % or more and 3.5 mass % or less.

Mo is an element which enhances the corrosion resistance of a stainless steel. However, a case where the Mo content is higher than 5 mass % is not desired because sigma phase generation is promoted, and base material embrittlement is caused. Therefore, the Mo content is 0 mass % (including a case where Mo is not added) or more and 5 mass % or less, and preferably 0.01 mass % or more and 3 mass % or less.

Al is an element which may be added as a deoxidizing material to a stainless steel produced using a versatile refining method, and an element which inevitably enters a steel deoxidized with Si such as the present invention due to erosion of e.g. impurities and a refractory in a raw material. In addition, when the Al content is higher than 0.005 mass %, large and hard $MgO{\cdot}Al_2O_3$ and/or large and hard $MnO{\cdot}Al_2O_3{\cdot}Cr_2O_3$ are generated, which has a negative effect on the polishability of a stainless steel. Therefore, the Al content is 0 mass % or more and 0.005 mass % or less, and preferably 0.003 mass % or less.

Mg is an element which inevitably enters a stainless steel produced using a versatile refining method. In addition, when the Mg content is higher than 0.0010 mass %, large and hard $MgO \cdot Al_2O_3$ is generated, which has a negative effect on the polishability of a stainless steel. Therefore, the Mg content is 0 mass % or more and 0.0010 mass % or less, and preferably 0.0005 mass % or less.

When the O content is lower than 0.0010 mass %, Si and Mn are not oxidized, and the MgO concentration and the $Al_2O_3$ concentration increase in an inclusion. Therefore, large and hard $MgO \cdot Al_2O_3$ is generated, which has a negative effect on the polishability of a stainless steel. In addition, when the O content is higher than 0.0060 mass %, large and hard $MnO \cdot Al_2O_3 \cdot Cr_2O_3$ is generated, which has a negative effect on the polishability of a stainless steel. Therefore, the O content is 0.0010 mass % or more and 0.0060 mass % or less, and preferably 0.0020 mass % or more and 0.0050 mass % or less.

N is an element which enhances the corrosion resistance of a stainless steel, and also an austenite stabilizing element. When the Al content is low as described above, N does not generate an inclusion. However, when the N content is higher than 0.5 mass %, air bubbles are generated in a steel ingot, which has a negative effect on the manufacturability of a stainless steel. Therefore, the N content is 0.0001 mass % or more and 0.5 mass % or less.

REM is an element which improves the hot workability of a stainless steel. When the REM content is higher than 0.0030 mass %, nozzle clogging occurs, which has a negative effect on manufacturability. In addition, REM is a selective element, and a case where REM is not added is also included. Therefore, the REM content is 0 mass % or more and 0.0030 mass % or less, and, when REM is contained, 0.00001 mass % or more and 0.0030 mass % or less.

Ca is an element which improves the hot workability of a stainless steel. Ca may be added in the form of e.g. a Ca—Si alloy after refining in VOD or AOD described below. In the present embodiment, even when a large amount of Ca is added, there is not a risk that the first inclusion and the second inclusion will increase, and thus the component is not particularly controlled. The Ca content is preferably 0.0001 mass % or more and 0.0050 mass % or less.

As with Ca, B is an element which improves the hot workability of a stainless steel, and may be thus added in a range of 0.0050 mass % or less as needed. When B is added, the B content is preferably 0.0001 mass % or more and 0.0030 mass % or less.

Ti and Nb generate precipitation together with C or N, and are effective to prevent grain coarsening at the time of heat treatment. Therefore, each may be added in a range of 0.50 mass % or less. When Ti and Nb are added, each content is 0.01 mass % or more and 0.30 mass % or less.

V, W, Co, and Sn all are elements which enhance the corrosion resistance of a stainless steel, and may be added as needed. When they are added, each content is preferably V: 0.01 mass % or more and 1.00 mass % or less, W: 0.01 mass % or more and 1.00 mass % or less, Co: 0.01 mass % or more and 1.00 mass % or less, and Sn: 0.01 mass % or more and 1.00 mass % or less.

Next, a method for producing the above stainless steel will be described.

When producing the above stainless steel, a raw material is melted and refined to produce a stainless steel having components adjusted as described above.

In the refining step, VOD or AOD is used.

In the present embodiment, in order to suppress the generation of a slag-based inclusion occurring at the time of reduction in the refining step, slag composition is controlled by increasing the purity of a reducing material and controlling the amount added, and the composition of inclusions in a stainless steel is controlled by controlling slag composition as described above.

That is, $MgO \cdot Al_2O_3$ exists in a large slag-based inclusion ($CaO—SiO_2—Al_2O_3—MgO—MnO—Cr_2O_3$-based) in the state of a cast piece, and prevents the slag-based inclusion from being made harmless by the extension thereof at the time of rolling, and thus has a very large negative effect. In contrast, $MnO \cdot Al_2O_3 \cdot Cr_2O_3$ is a hard inclusion, but, in the state of a cast piece, can be controlled to fine inclusions. In the present embodiment, therefore, while making a state in which $MnO \cdot Al_2O_3 \cdot Cr_2O_3$ is more easily generated than $MgO \cdot Al_2O_3$ on purpose, the components in a steel, slag composition, and basicity ($CaO/SiO_2$) are adjusted so that $MnO \cdot Al_2O_3 \cdot Cr_2O_3$ becomes fine.

In the present embodiment, adjustment is made so that Al and $Al_2O_3$ contained in a raw material or a ladle will be removed to the extent of not having problems with refining in the refining step. In addition, deoxidation is performed using a sufficient amount of Fe—Si alloy or metal Si so that the O concentration in a steel will be within the above range, and furthermore CaO or $SiO_2$ is added.

Therefore, the refining slag composition is controlled at, in mass % ratio, $CaO/SiO_2$: 1.1 or more and 1.7 or less, preferably 1.2 or more and 1.6 or less, $Al_2O_3$: 4.0 mass % or less, preferably 2.0 mass % or less, and MgO: 10.0 mass % or less, preferably 8.0 mass % or less. This slag composition is values after VOD or after AOD and LF. When $CaO/SiO_2$ is higher than 1.7, the second inclusion excessively increases, and when $CaO/SiO_2$ is lower than 1.1, the first inclusion excessively increases.

In addition, molten steel is stirred at a stirring power of 50 W/ton or more for 5 minutes or more after adding a refining slag material. When the stirring power is less than 50 W/ton, the second inclusion with low density and a high degree of harmfulness does not sufficiently float, and thus excessively increases. In addition, when the stirring time is less than 5 minutes, both the first inclusion and second inclusion do not float and thus excessively increase. When the stirring power is 150 W/ton or more, the second inclusion catches a refining slag existing on the molten steel and increases. The upper limit of the stirring time is not particularly determined, but the stirring time is preferably 30 minutes or less because the effect by stirring is saturated while loads of equipment and efficiency for the production are reduced. In addition to methods by gas blowing in VOD and LF, stirring can be carried out by other methods such as mechanical mixing and electromagnetic stirring.

After the refining step followed by the continuous casting process, a slab with a predetermined thickness or a billet with a predetermined square size is formed.

After that, the slab with a predetermined thickness is subjected to a hot rolling step and pickling step to produce a stainless steel sheet with a predetermined thickness, or the billet with a predetermined square size is subjected to a hot rolling step and pickling step to produce wire (steel wire, stainless wire) with a predetermined diameter. In any case, an annealing step and/or pickling step may be then carried out depending on dimensions required. After the pickling step, a cold rolling step may be further carried out.

Consequently, a stainless steel, which includes the first inclusion with an equivalent circle diameter of 5 μm or more, having the average composition of MnO: 5 mass % or more, $Cr_2O_3+Al_2O_3$: 20 mass % or more, $Al_2O_3$: 1 mass % or more, and CaO: 5 mass % or less, at 0.5 inclusions/$mm^2$ or less, and further includes the second inclusion with an equivalent circle diameter of 5 μm or more, having the average composition of MgO: 10 mass % or more and $Al_2O_3$: 20 mass % or more, at 0.2 inclusions/mm$^2$ or less, and is also adjusted so that the sum of the first inclusion and the second inclusion with an equivalent circle diameter of 5 μm or more will be 0.5 inclusions/mm$^2$ or less, and/or products such as a steel sheet and wire (steel wire, stainless wire) produced using this stainless steel can be produced.

As described above, according to the present embodiment, the concentrations of Al and O in a steel can be adjusted by adjusting the composition of a floating slag and performing sufficient deoxidation in molten stainless steel after the refining step. Because of this, the generation of $MgO \cdot Al_2O_3$-based hard nonmetallic inclusion (first inclusion) occurring at high Al and low O can be stably suppressed, and also the generation of $MnO \cdot Al_2O_3 \cdot Cr_2O_3$-based hard nonmetallic inclusion (second inclusion) occurring at high O can be stably suppressed. Therefore, stainless steel products can be produced, which have a few defects such as pits and pin holes caused by the inclusions at the time of polishing, and a very high degree of specularity, i.e. good mirror polishability. Therefore, the present embodiment can be suitably used as a stainless steel for materials used after mirror polishing.

Example 1

Examples and Comparative Examples will now be described.

Using 80 tons of an austenitic stainless steel, having each steel composition of samples No. 1 to 11, samples No. 23 to 37, and samples No. 49 to 54 shown in Table 1, a slab with a thickness of 200 mm was produced by an electric furnace, a converter, a VOD refining process, and a continuous casting process. The amount of each element shown in Table 1 is a value by mass %. It should be noted that as shown in Table 2, the basicity $CaO/SiO_2$ of slag used was changed between 1.0 to 2.0 in reduction refining in VOD, and also the raw material used as a deoxidizing agent was changed to produce steel materials with different concentrations of Si, Al, and O. It should be noted that after adding a refining slag, molten steel was stirred at a stirring power of 100 W/ton for 20 minutes.

Next, each slab was subjected to hot rolling, cold rolling, and pickling to obtain a cold-rolled coil with a sheet thickness of 0.3 mm to 10 mm, and a steel sheet sample was taken from the coil.

In addition, using 60 tons of an austenitic stainless steel, having each steel composition of samples No. 12 to 22, samples No. 38 to 48, and samples No. 55 to 59 shown in Table 1, a billet with a 150 mm square was produced by an electric furnace, an AOD refining process, LF, and a continuous casting process. It should be noted that as shown in Table 2, the basicity $CaO/SiO_2$ of slag used was changed between 1.0 to 2.0 in reduction refining in AOD, and also the concentrations of Si and Al used as a deoxidizing agent were changed. It should be noted that after adding a refining slag, Ar bottom-blowing was carried out in VOD or LF, and molten steel was stirred at a stirring power of 100 W/ton for 20 minutes.

TABLE 1

| | | Components in steel | | | | | | | | | | | | |
|---|---|---|---|---|---|---|---|---|---|---|---|---|---|---|
| Category | No. | C | Si | Mn | Ni | S | Cr | Cu | Mo | Al | N | Ca | Mg | O |
| Examples | 1 | 0.07 | 0.58 | 0.6 | 7.6 | 0.005 | 16.6 | 0.2 | 0.2 | 0.002 | 0.032 | 0.0001 | 0.0002 | 0.0047 |
| | 2 | 0.05 | 0.74 | 0.8 | 7.6 | 0.005 | 16.6 | 0.4 | 0.1 | 0.001 | 0.048 | 0.0003 | 0.0001 | 0.0035 |
| | 3 | 0.06 | 0.35 | 0.8 | 7.7 | 0.005 | 16.3 | 0.1 | 0.2 | 0.002 | 0.044 | 0.0002 | 0.0001 | 0.0035 |
| | 4 | 0.06 | 0.63 | 0.7 | 7.7 | 0.002 | 16.5 | 0.4 | 0.2 | 0.001 | 0.032 | 0.0001 | 0.0001 | 0.0019 |
| | 5 | 0.05 | 0.34 | 0.7 | 7.4 | 0.001 | 16.4 | 0.2 | 0.2 | 0.003 | 0.049 | 0.0001 | 0.0002 | 0.0019 |
| | 6 | 0.06 | 0.48 | 0.6 | 7.8 | 0.003 | 16.5 | 0.3 | 0.2 | 0.001 | 0.039 | 0.0002 | 0.0001 | 0.0026 |
| | 7 | 0.06 | 0.48 | 0.7 | 7.6 | 0.004 | 16.3 | 0.4 | 0.1 | 0.002 | 0.040 | 0.0002 | 0.0001 | 0.0040 |
| | 8 | 0.01 | 0.32 | 1.7 | 8.0 | 0.001 | 17.1 | 3.0 | 0.2 | 0.003 | 0.043 | 0.0005 | 0.0002 | 0.0043 |
| | 9 | 0.01 | 0.28 | 1.6 | 7.9 | 0.003 | 16.9 | 3.2 | 0.2 | 0.001 | 0.044 | 0.0003 | 0.0002 | 0.0038 |
| | 10 | 0.05 | 0.68 | 0.6 | 7.7 | 0.004 | 16.4 | 0.2 | 0.2 | 0.001 | 0.037 | 0.0000 | 0.0001 | 0.0028 |
| | 11 | 0.06 | 0.55 | 0.8 | 7.7 | 0.005 | 16.3 | 0.3 | 0.1 | 0.002 | 0.033 | 0.0002 | 0.0001 | 0.0053 |
| | 12 | 0.05 | 0.63 | 0.7 | 7.8 | 0.003 | 16.4 | 0.4 | 0.2 | 0.001 | 0.038 | 0.0002 | 0.0001 | 0.0043 |
| | 13 | 0.05 | 0.45 | 0.6 | 7.6 | 0.002 | 16.6 | 0.2 | 0.1 | 0.002 | 0.033 | 0.0004 | 0.0002 | 0.0031 |
| | 14 | 0.07 | 0.51 | 0.5 | 7.5 | 0.003 | 16.4 | 0.4 | 0.1 | 0.002 | 0.047 | 0.0001 | 0.0001 | 0.0039 |
| | 15 | 0.06 | 0.65 | 0.5 | 7.7 | 0.004 | 16.5 | 0.3 | 0.2 | 0.002 | 0.042 | 0.0004 | 0.0001 | 0.0036 |
| | 16 | 0.06 | 0.77 | 0.6 | 7.5 | 0.005 | 16.4 | 0.3 | 0.2 | 0.002 | 0.037 | 0.0000 | 0.0000 | 0.0048 |
| | 17 | 0.06 | 0.32 | 0.7 | 7.6 | 0.003 | 16.4 | 0.3 | 0.1 | 0.003 | 0.033 | 0.0002 | 0.0001 | 0.0044 |
| | 18 | 0.06 | 0.60 | 0.6 | 7.6 | 0.003 | 16.6 | 0.3 | 0.2 | 0.003 | 0.038 | 0.0004 | 0.0002 | 0.0037 |
| | 19 | 0.06 | 0.55 | 1.2 | 7.7 | 0.004 | 16.5 | 0.2 | 0.2 | 0.003 | 0.036 | 0.0003 | 0.0001 | 0.0045 |
| | 20 | 0.06 | 0.54 | 1.1 | 7.5 | 0.004 | 16.4 | 0.4 | 0.2 | 0.003 | 0.033 | 0.0001 | 0.0001 | 0.0047 |
| | 21 | 0.05 | 0.67 | 0.5 | 7.3 | 0.004 | 16.5 | 0.3 | 0.2 | 0.003 | 0.034 | 0.0007 | 0.0000 | 0.0050 |
| | 22 | 0.05 | 0.43 | 0.8 | 7.7 | 0.002 | 16.5 | 0.3 | 0.2 | 0.002 | 0.040 | 0.0009 | 0.0001 | 0.0024 |
| | 23 | 0.02 | 0.36 | 0.8 | 12.3 | 0.004 | 18.5 | 0.4 | 2.1 | 0.001 | 0.049 | 0.0002 | 0.0000 | 0.0043 |
| | 24 | 0.02 | 0.56 | 0.9 | 11.9 | 0.002 | 18.5 | 0.2 | 2.0 | 0.002 | 0.050 | 0.0003 | 0.0001 | 0.0051 |
| | 25 | 0.01 | 0.65 | 1.4 | 12.0 | 0.003 | 18.3 | 0.2 | 2.0 | 0.001 | 0.048 | 0.0001 | 0.0000 | 0.0039 |
| | 26 | 0.02 | 0.43 | 1.5 | 11.8 | 0.003 | 18.2 | 0.4 | 2.1 | 0.001 | 0.033 | 0.0000 | 0.0001 | 0.0036 |
| | 27 | 0.03 | 0.53 | 1.1 | 12.2 | 0.006 | 18.4 | 0.3 | 2.1 | 0.002 | 0.045 | 0.0002 | 0.0000 | 0.0048 |
| | 28 | 0.01 | 0.36 | 1.1 | 13.0 | 0.004 | 18.8 | 0.2 | 2.6 | 0.001 | 0.043 | 0.0001 | 0.0000 | 0.0044 |
| | 29 | 0.01 | 0.78 | 1.0 | 13.0 | 0.003 | 18.7 | 0.3 | 2.6 | 0.003 | 0.031 | 0.0004 | 0.0002 | 0.0037 |
| | 30 | 0.05 | 0.52 | 3.0 | 12.2 | 0.005 | 16.4 | 0.3 | 2.7 | 0.002 | 0.049 | 0.0003 | 0.0001 | 0.0038 |
| | 31 | 0.05 | 0.46 | 2.8 | 12.1 | 0.006 | 16.4 | 0.2 | 2.9 | 0.002 | 0.043 | 0.0003 | 0.0001 | 0.0037 |
| | 32 | 0.03 | 0.45 | 1.0 | 13.1 | 0.002 | 18.9 | 0.4 | 2.7 | 0.001 | 0.030 | 0.0003 | 0.0002 | 0.0050 |
| | 33 | 0.01 | 0.71 | 1.0 | 13.0 | 0.002 | 18.8 | 0.3 | 2.6 | 0.001 | 0.020 | 0.0005 | 0.0003 | 0.0024 |
| | 34 | 0.02 | 0.50 | 1.0 | 13.8 | 0.003 | 17.6 | 0.1 | 2.6 | 0.000 | 0.030 | 0.0002 | 0.0001 | 0.0059 |
| | 35 | 0.02 | 0.51 | 1.0 | 13.8 | 0.004 | 17.6 | 0.1 | 2.6 | 0.000 | 0.036 | 0.0001 | 0.0000 | 0.0051 |
| | 36 | 0.02 | 0.61 | 1.0 | 13.9 | 0.003 | 17.7 | 0.1 | 2.6 | 0.000 | 0.090 | 0.0000 | 0.0000 | 0.0045 |
| | 37 | 0.02 | 0.55 | 1.1 | 13.7 | 0.004 | 17.5 | 0.3 | 2.6 | 0.000 | 0.120 | 0.0001 | 0.0001 | 0.0054 |
| | 38 | 0.02 | 0.38 | 0.9 | 12.1 | 0.005 | 18.4 | 0.2 | 2.1 | 0.002 | 0.043 | 0.0003 | 0.0000 | 0.0055 |

TABLE 1-continued

| Category | No. | Components in steel | | | | | | | | | | | | |
|---|---|---|---|---|---|---|---|---|---|---|---|---|---|---|
| | | C | Si | Mn | Ni | S | Cr | Cu | Mo | Al | N | Ca | Mg | O |
| | 39 | 0.03 | 0.66 | 0.9 | 11.9 | 0.003 | 18.4 | 0.3 | 2.0 | 0.001 | 0.033 | 0.0005 | 0.0002 | 0.0044 |
| | 40 | 0.01 | 0.75 | 1.5 | 12.3 | 0.002 | 18.4 | 0.3 | 2.0 | 0.003 | 0.039 | 0.0002 | 0.0001 | 0.0022 |
| | 41 | 0.03 | 0.77 | 1.5 | 12.3 | 0.003 | 18.4 | 0.4 | 2.1 | 0.002 | 0.046 | 0.0002 | 0.0000 | 0.0049 |
| | 42 | 0.01 | 0.32 | 1.1 | 12.1 | 0.002 | 18.4 | 0.2 | 2.2 | 0.002 | 0.034 | 0.0005 | 0.0003 | 0.0023 |
| | 43 | 0.02 | 0.37 | 1.1 | 13.0 | 0.002 | 18.9 | 0.4 | 2.6 | 0.001 | 0.035 | 0.0002 | 0.0002 | 0.0033 |
| | 44 | 0.02 | 0.54 | 1.0 | 13.2 | 0.003 | 18.6 | 0.3 | 2.6 | 0.002 | 0.033 | 0.0002 | 0.0001 | 0.0045 |
| | 45 | 0.02 | 0.48 | 0.8 | 13.3 | 0.003 | 18.8 | 0.2 | 2.7 | 0.002 | 0.040 | 0.0003 | 0.0001 | 0.0037 |
| | 46 | 0.02 | 0.50 | 0.8 | 13.6 | 0.003 | 18.8 | 0.2 | 2.9 | 0.002 | 0.032 | 0.0002 | 0.0001 | 0.0038 |
| | 47 | 0.01 | 0.32 | 1.0 | 13.0 | 0.003 | 18.9 | 0.3 | 2.6 | 0.002 | 0.044 | 0.0006 | 0.0002 | 0.0035 |
| | 48 | 0.03 | 0.37 | 1.1 | 13.2 | 0.002 | 19.0 | 0.2 | 2.6 | 0.001 | 0.048 | 0.0008 | 0.0001 | 0.0029 |
| Comparative | 49 | 0.06 | 0.26 | 0.8 | 7.3 | 0.004 | 18.4 | 0.4 | 0.1 | 0.002 | 0.034 | 0.0002 | 0.0001 | 0.0050 |
| Examples | 50 | 0.05 | 0.7 | 0.8 | 7.4 | 0.004 | 18.4 | 0.2 | 0.2 | 0.002 | 0.032 | 0.0001 | 0.0001 | 0.0050 |
| | 51 | 0.06 | 0.7 | 0.8 | 11.8 | 0.001 | 18.4 | 0.3 | 0.1 | 0.006 | 0.042 | 0.0000 | 0.0002 | 0.0030 |
| | 52 | 0.02 | 0.7 | 0.8 | 11.8 | 0.001 | 18.4 | 0.3 | 0.2 | 0.002 | 0.044 | 0.0006 | 0.0002 | 0.0020 |
| | 53 | 0.02 | 0.7 | 0.8 | 13.0 | 0.007 | 18.6 | 0.2 | 0.1 | 0.001 | 0.043 | 0.0002 | 0.0001 | 0.0075 |
| | 54 | 0.01 | 0.5 | 0.8 | 13.0 | 0.003 | 19.0 | 0.2 | 2.6 | 0.004 | 0.02 | 0.0003 | 0.0000 | 0.0050 |
| | 55 | 0.05 | 0.25 | 0.8 | 7.3 | 0.004 | 18.4 | 0.3 | 2.6 | 0.002 | 0.039 | 0.0001 | 0.0001 | 0.0050 |
| | 56 | 0.06 | 0.7 | 0.8 | 7.4 | 0.003 | 18.4 | 0.3 | 2.6 | 0.003 | 0.030 | 0.0004 | 0.0001 | 0.0050 |
| | 57 | 0.06 | 0.7 | 0.8 | 11.8 | 0.003 | 18.4 | 0.3 | 2.6 | 0.002 | 0.041 | 0.0000 | 0.0002 | 0.0070 |
| | 58 | 0.01 | 0.7 | 0.8 | 11.8 | 0.004 | 19.1 | 0.2 | 2.6 | 0.001 | 0.035 | 0.0004 | 0.0002 | 0.0050 |
| | 59 | 0.02 | 0.7 | 0.8 | 13.0 | 0.001 | 19.0 | 0.3 | 0.1 | 0.005 | 0.043 | 0.0001 | 0.0001 | 0.0030 |

Next, wire (steel wire, stainless wire) with 4.0 to 40 mmφ was produced by wire rolling, and a sample of the wire (steel wire, stainless wire) was taken.

The sample surface of each of the steel sheet sample and wire (steel wire, stainless wire) sample was mirror-finished by polishing with emery paper and buffing. The number of inclusions existing in a 100 $mm^2$ area was then counted using SEM (scanning electron microscope) and EDS (energy dispersive X-ray spectroscopy), and the composition of the inclusions was measured by EDS to determine contamination and determine the type of inclusion.

After this, specular glossiness (reflectance) at a reflection angle of 20 degrees in accordance with JIS 28741 was measured.

TABLE 2

| Category | No. | Slag components | | | Refining | Shape | Sheet thickness mmt Diameter mmφ | First inclusion inclusions/ $mm^2$ (≥5 μm) | Second inclusion inclusions/ $mm^2$ (≥5 μm) | First and second inclusions inclusions/ $mm^2$ (≥5 μm) | Glossiness |
|---|---|---|---|---|---|---|---|---|---|---|---|
| | | C/S | $Al_2O_3$ | MgO | method | | | | | | |
| Examples | 1 | 1.3 | 2.7 | 6.6 | VOD | Sheet | 3.0 mmt | 0.17 | 0.05 | 0.22 | 1293 |
| | 2 | 1.4 | 2.5 | 7.7 | VOD | Sheet | 3.0 mmt | 0.07 | 0.05 | 0.12 | 1286 |
| | 3 | 1.4 | 3.4 | 2.1 | VOD | Sheet | 3.0 mmt | 0.16 | 0.02 | 0.18 | 1295 |
| | 4 | 1.6 | 2.8 | 6.4 | VOD | Sheet | 3.0 mmt | 0.15 | 0.11 | 0.26 | 1292 |
| | 5 | 1.7 | 2.8 | 3.4 | VOD | Sheet | 3.0 mmt | 0.00 | 0.14 | 0.14 | 1284 |
| | 6 | 1.5 | 1.9 | 5.5 | VOD | Sheet | 3.0 mmt | 0.21 | 0.05 | 0.26 | 1288 |
| | 7 | 1.2 | 3.6 | 5.4 | VOD | Sheet | 3.0 mmt | 0.19 | 0.18 | 0.36 | 1296 |
| | 8 | 1.4 | 2.3 | 4.5 | VOD | Sheet | 0.3 mmt | 0.10 | 0.11 | 0.21 | 1290 |
| | 9 | 1.4 | 2.7 | 3.8 | VOD | Sheet | 0.3 mmt | 0.15 | 0.13 | 0.28 | 1293 |
| | 10 | 1.4 | 2.1 | 3.1 | VOD | Sheet | 3.0 mmt | 0.12 | 0.03 | 0.16 | 1288 |
| | 11 | 1.1 | 3.7 | 5.3 | VOD | Sheet | 3.0 mmt | 0.11 | 0.03 | 0.14 | 1292 |
| | 12 | 1.5 | 2.3 | 6.5 | AOD | Wire | 6.0 mmφ | 0.04 | 0.06 | 0.10 | 1291 |
| | 13 | 1.7 | 3.1 | 6.9 | AOD | Wire | 6.0 mmφ | 0.19 | 0.08 | 0.27 | 1289 |
| | 14 | 1.6 | 2.4 | 9.2 | AOD | Wire | 6.0 mmφ | 0.21 | 0.08 | 0.29 | 1288 |
| | 15 | 1.5 | 2.5 | 4.9 | AOD | Wire | 6.0 mmφ | 0.13 | 0.07 | 0.20 | 1293 |
| | 16 | 1.4 | 2.8 | 5.0 | AOD | Wire | 6.0 mmφ | 0.24 | 0.07 | 0.31 | 1283 |
| | 17 | 1.5 | 3.1 | 6.2 | AOD | Wire | 6.0 mmφ | 0.16 | 0.12 | 0.29 | 1295 |
| | 18 | 1.5 | 3.3 | 5.7 | AOD | Wire | 6.0 mmφ | 0.05 | 0.07 | 0.12 | 1288 |
| | 19 | 1.4 | 3.2 | 4.8 | AOD | Wire | 4.0 mmφ | 0.09 | 0.09 | 0.18 | 1286 |
| | 20 | 1.4 | 3.3 | 4.4 | AOD | Wire | 4.0 mmφ | 0.06 | 0.09 | 0.16 | 1289 |
| | 21 | 1.4 | 2.2 | 4.8 | AOD | Wire | 6.0 mmφ | 0.09 | 0.04 | 0.13 | 1293 |
| | 22 | 1.6 | 1.9 | 6.4 | AOD | Wire | 6.0 mmφ | 0.11 | 0.07 | 0.18 | 1282 |
| | 23 | 1.4 | 3.0 | 5.9 | VOD | Sheet | 6.0 mmt | 0.11 | 0.09 | 0.20 | 1284 |
| | 24 | 1.6 | 3.1 | 4.6 | VOD | Sheet | 6.0 mmt | 0.26 | 0.14 | 0.40 | 1294 |
| | 25 | 1.6 | 2.5 | 5.8 | VOD | Sheet | 6.0 mmt | 0.13 | 0.09 | 0.22 | 1300 |
| | 26 | 1.5 | 3.1 | 5.6 | VOD | Sheet | 6.0 mmt | 0.11 | 0.12 | 0.24 | 1293 |
| | 27 | 1.2 | 3.0 | 8.5 | VOD | Sheet | 6.0 mmt | 0.23 | 0.07 | 0.31 | 1282 |
| | 28 | 1.4 | 3.3 | 5.4 | VOD | Sheet | 6.0 mmt | 0.21 | 0.03 | 0.24 | 1292 |
| | 29 | 1.5 | 2.5 | 5.2 | VOD | Sheet | 6.0 mmt | 0.08 | 0.07 | 0.15 | 1297 |
| | 30 | 1.3 | 2.9 | 6.3 | VOD | Sheet | 10 mmt | 0.12 | 0.03 | 0.15 | 1291 |
| | 31 | 1.3 | 3.9 | 6.5 | VOD | Sheet | 10 mmt | 0.25 | 0.19 | 0.44 | 1290 |
| | 32 | 1.6 | 2.8 | 4.1 | VOD | Sheet | 6.0 mmt | 0.12 | 0.12 | 0.23 | 1293 |

TABLE 2-continued

| Category | No. | Slag components C/S | Slag components $Al_2O_3$ | Slag components MgO | Refining method | Shape | Sheet thickness mmt Diameter mmφ | First inclusion inclusions/ $mm^2$ (≥5 μm) | Second inclusion inclusions/ $mm^2$ (≥5 μm) | First and second inclusions inclusions/ $mm^2$ (≥5 μm) | Glossiness |
|---|---|---|---|---|---|---|---|---|---|---|---|
| | 33 | 1.7 | 2.9 | 6.3 | VOD | Sheet | 6.0 mmt | 0.14 | 0.15 | 0.29 | 1291 |
| | 34 | 1.4 | 2.4 | 4.1 | VOD | Sheet | 6.0 mmt | 0.32 | 0.00 | 0.32 | 1289 |
| | 35 | 1.5 | 2.8 | 4.5 | VOD | Sheet | 6.0 mmt | 0.22 | 0.00 | 0.22 | 1289 |
| | 36 | 1.5 | 2.2 | 4.3 | VOD | Sheet | 6.0 mmt | 0.14 | 0.00 | 0.14 | 1281 |
| | 37 | 1.6 | 3.0 | 5.5 | VOD | Sheet | 6.0 mmt | 0.30 | 0.03 | 0.33 | 1295 |
| | 38 | 1.1 | 2.9 | 5.7 | AOD | Wire | 11 mmφ | 0.26 | 0.08 | 0.34 | 1284 |
| | 39 | 1.4 | 3.5 | 6.2 | AOD | Wire | 11 mmφ | 0.21 | 0.19 | 0.40 | 1282 |
| | 40 | 1.5 | 3.2 | 4.8 | AOD | Wire | 11 mmφ | 0.14 | 0.18 | 0.32 | 1280 |
| | 41 | 1.5 | 3.6 | 5.9 | AOD | Wire | 11 mmφ | 0.19 | 0.20 | 0.38 | 1289 |
| | 42 | 1.7 | 3.2 | 6.6 | AOD | Wire | 11 mmφ | 0.12 | 0.18 | 0.30 | 1282 |
| | 43 | 1.6 | 3.4 | 4.7 | AOD | Wire | 11 mmφ | 0.15 | 0.19 | 0.34 | 1284 |
| | 44 | 1.5 | 3.3 | 4.4 | AOD | Wire | 11 mmφ | 0.05 | 0.15 | 0.19 | 1281 |
| | 45 | 1.6 | 1.7 | 5.2 | AOD | Wire | 40 mmφ | 0.02 | 0.01 | 0.03 | 1283 |
| | 46 | 1.5 | 2.8 | 4.4 | AOD | Wire | 40 mmφ | 0.03 | 0.03 | 0.06 | 1294 |
| | 47 | 1.3 | 3.2 | 4.9 | AOD | Wire | 11 mmφ | 0.15 | 0.15 | 0.30 | 1289 |
| | 48 | 1.6 | 2.9 | 6.4 | AOD | Wire | 11 mmφ | 0.14 | 0.15 | 0.28 | 1297 |
| Comparative Examples | 49 | 1.4 | 2.7 | 4.8 | VOD | Sheet | 3.0 mmt | 0.52 | 0.06 | 0.58 | 1270 |
| | 50 | 1.4 | 3.4 | 10.5 | VOD | Sheet | 3.0 mmt | 0.49 | 0.23 | 0.72 | 1274 |
| | 51 | 1.8 | 3.4 | 5.8 | VOD | Sheet | 3.0 mmt | 0.06 | 0.22 | 0.28 | 1269 |
| | 52 | 1.9 | 2.5 | 4.2 | VOD | Sheet | 6.0 mmt | 0.13 | 0.21 | 0.34 | 1276 |
| | 53 | 1.0 | 2.0 | 6.6 | VOD | Sheet | 6.0 mmt | 0.91 | 0.00 | 0.92 | 1274 |
| | 54 | 1.5 | 4.2 | 5.9 | VOD | Sheet | 6.0 mmt | 0.15 | 0.31 | 0.46 | 1276 |
| | 55 | 1.4 | 2.3 | 5.7 | AOD | Wire | 6.0 mmφ | 0.47 | 0.04 | 0.51 | 1277 |
| | 56 | 1.4 | 3.2 | 11.0 | AOD | Wire | 6.0 mmφ | 0.27 | 0.22 | 0.49 | 1279 |
| | 57 | 1.0 | 2.1 | 5.2 | AOD | Wire | 6.0 mmφ | 0.73 | 0.12 | 0.85 | 1270 |
| | 58 | 1.5 | 4.5 | 4.8 | AOD | Wire | 11.0 mmφ | 0.13 | 0.39 | 0.51 | 1270 |
| | 59 | 1.8 | 2.6 | 5.8 | AOD | Wire | 11.0 mmφ | 0.19 | 0.25 | 0.44 | 1269 |

Samples No. 1 to 11, samples No. 23 to 37, samples No. 12 to 22, and samples No. 38 to 48 in Tables each correspond to Examples. These samples met the ranges of the above embodiment about the components in a steel and the slag components in the refining step, and therefore the number density of prescribed hard inclusions (the first inclusion and second inclusion) was low and the glossiness was high (1280 or more), and good quality could be obtained.

In contrast, samples No. 49 to 54, and samples No. 55 to 59 in Tables each correspond to Comparative Examples. These samples were beyond the ranges of the above embodiment about the components in a steel and/or the slag components in the refining step (underlines in Tables), and therefore the number density of prescribed hard inclusions (the first inclusion and second inclusion) was high (underlines in Table), and the glossiness was poor (less than 1280).

Example 2

Samples No. 60 to 69 shown in Table 3 were produced in the same manner as in Example 1 except that the amount of bottom blowing gas in VOD or LF was changed, and the stirring power and the stirring time were changed as shown in Table 4, and a steel sheet or wire (steel wire, stainless wire) sample was taken and evaluated.

TABLE 3

| Category | No. | Components in steel C | Si | Mn | Ni | S | Cr | Cu | Mo | Al | N | Ca | Mg | O | Others |
|---|---|---|---|---|---|---|---|---|---|---|---|---|---|---|---|
| Examples | 60 | 0.07 | 0.44 | 0.9 | 7.6 | 0.0007 | 17.8 | 0.1 | 0.2 | 0.002 | 0.026 | 0.0005 | 0.0002 | 0.0031 | |
| | 61 | 0.06 | 0.72 | 0.8 | 8.0 | 0.0020 | 17.8 | 0.1 | 0.2 | 0.003 | 0.031 | 0.0005 | 0.0003 | 0.0030 | |
| | 62 | 0.06 | 0.71 | 0.8 | 7.8 | 0.0018 | 17.4 | 0.3 | 0.2 | 0.001 | 0.036 | 0.0004 | 0.0004 | 0.0036 | REM: 0.0002% B: 0.0020% |
| | 63 | 0.02 | 0.74 | 0.8 | 8.0 | 0.0015 | 17.8 | 0.1 | 0.3 | 0.003 | 0.022 | 0.0004 | 0.0003 | 0.0048 | Ti: 0.01% V: 0.01% |
| | 64 | 0.02 | 0.73 | 0.8 | 7.6 | 0.0015 | 17.9 | 0.2 | 0.3 | 0.001 | 0.025 | 0.0005 | 0.0003 | 0.0049 | Nb: 0.3% W: 0.5% |
| | 65 | 0.07 | 0.40 | 0.9 | 7.9 | 0.0005 | 17.6 | 0.1 | 0.2 | 0.001 | 0.035 | 0.0003 | 0.0001 | 0.0031 | Co: 0.3% Sn: 0.1% |
| Comparative Examples | 66 | 0.05 | 0.56 | 0.9 | 7.9 | 0.0011 | 17.5 | 0.2 | 0.1 | 0.003 | 0.022 | 0.0004 | 0.0003 | 0.0045 | |
| | 67 | 0.02 | 0.68 | 0.7 | 7.9 | 0.0014 | 17.7 | 0.3 | 0.2 | 0.001 | 0.022 | 0.0004 | 0.0003 | 0.0046 | |
| | 68 | 0.02 | 0.43 | 0.8 | 7.6 | 0.0006 | 18.0 | 0.2 | 0.2 | 0.001 | 0.037 | 0.0004 | 0.0002 | 0.0020 | |
| | 69 | 0.06 | 0.47 | 0.7 | 7.6 | 0.0011 | 17.6 | 0.2 | 0.2 | 0.001 | 0.029 | 0.0005 | 0.0001 | 0.0027 | |

TABLE 4

| Category | No. | Slag components C/S | $Al_2O_3$ | MgO | Stirring conditions Stirring power W/ton | Holding time min | Refining method | Shape | Sheet thickness mmt Diameter mmφ | First inclusion inclusions/$mm^2$ (≥5 μm) | Second inclusion inclusions/$mm^2$ (≥5 μm) | First and second inclusions inclusions/$mm^2$ (≥5 μm) | Glossiness |
|---|---|---|---|---|---|---|---|---|---|---|---|---|---|
| Examples | 60 | 1.6 | 2.7 | 9.1 | 65 | 11 | VOD | Sheet | 0.3 mmt | 0.09 | 0.13 | 0.22 | 1289 |
| | 61 | 1.2 | 2.5 | 4.6 | 65 | 8 | VOD | Sheet | 3.0 mmt | 0.21 | 0.09 | 0.30 | 1285 |
| | 62 | 1.5 | 2.5 | 8.0 | 65 | 13 | VOD | Sheet | 0.3 mmt | 0.09 | 0.12 | 0.21 | 1290 |
| | 63 | 1.3 | 2.6 | 7.5 | 100 | 14 | VOD | Sheet | 3.0 mmt | 0.15 | 0.09 | 0.24 | 1288 |
| | 64 | 1.4 | 2.3 | 6.0 | 100 | 18 | AOD + LF | Wire | 6.0 mmφ | 0.13 | 0.13 | 0.26 | 1287 |
| | 65 | 1.3 | 2.1 | 4.3 | 120 | 12 | AOD + LF | Wire | 11.0 mmφ | 0.16 | 0.10 | 0.26 | 1287 |
| Comparative Examples | 66 | 1.3 | 2.6 | 9.1 | 20 | 15 | VOD | Sheet | 0.3 mmt | 0.18 | 0.33 | 0.51 | 1260 |
| | 67 | 1.2 | 2.3 | 9.9 | 30 | 28 | VOD | Sheet | 3.0 mmt | 0.24 | 0.24 | 0.48 | 1261 |
| | 68 | 1.4 | 3.0 | 8.6 | 70 | 3 | AOD + LF | Wire | 6.0 mmφ | 0.55 | 0.41 | 0.96 | 1242 |
| | 69 | 1.5 | 2.1 | 7.2 | 200 | 12 | AOD + LF | Wire | 11.0 mmφ | 0.10 | 0.37 | 0.47 | 1261 |

Samples No. 60 to 65 in Table 4 each correspond to Examples. These samples met the conditions of the present invention, and the stirring power and the stirring time confirmed in Example 1, and therefore the number density of prescribed hard inclusions (the first inclusion and second inclusion) was low, glossiness was high (1280 or more), and good quality could be obtained.

In contrast, samples No. 66 to 69 in Table 4 each correspond to Comparative Examples. These samples met the conditions of the present invention confirmed in Example 1, but were beyond the stirring power and the stirring time (underlines in Table), and therefore the number density of a prescribed hard inclusion (the second inclusion) was high (underlines in Table), and the glossiness was poor (less than 1280).

Therefore, as shown in each of the above Examples, it was verified that a stainless steel with good mirror polishability could be produced by meeting the conditions of the present invention.

The invention claimed is:

1. A stainless steel, comprising:

C: 0.0001 mass % or more and 0.15 mass % or less,

Si: 0.30 mass % or more and 2.0 mass % or less,

Mn: 0.1 mass % or more and 15 mass % or less,

Ni: 5 mass % or more and 30 mass % or less,

S: 0.0001 mass % or more and 0.01 mass % or less,

Cr: 16 mass % or more and 25 mass % or less,

Mo: 0 mass % or more and 5 mass % or less,

Al: 0 mass % or more and 0.005 mass % or less,

Mg: 0 mass % or more and 0.0010 mass % or less,

O: 0.0010 mass % or more and 0.0060 mass % or less,

N: 0.0001 mass % or more and 0.5 mass % or less, and a remainder comprising Fe and inevitable impurities, and comprising at least one first inclusion with an equivalent circle diameter of 5 μm or more, having an average composition of MnO: 5 mass % or more, $Cr_2O_3$+$Al_2O_3$: 20 mass % or more, $Al_2O_3$: 1 mass % or more, and CaO: 5 mass % or less, wherein a number density of the at least one first inclusion is 0.5 inclusions/$mm^2$ or less.

2. The stainless steel according to claim 1, further comprising at least one second inclusion with an equivalent circle diameter of 5 μm or more, having an average composition of MgO: 10 mass % or more and $Al_2O_3$: 20 mass % or more, wherein the number density of the at least one second inclusion is 0.2 inclusions/$mm^2$ or less, and the number density of the sum of the at least one first inclusion and the at least one second inclusion is 0.5 inclusions/$mm^2$ or less.

3. The stainless steel according to claim 1, further containing at least any one of Cu: 0.1 mass % or more and 4.0 mass % or less, REM: 0.00001 mass % or more and 0.0030 mass % or less, Ca: 0.0001 mass % or more and 0.0050 mass % or less, B: 0.0001 mass % or more and 0.0050 mass % or less, Ti: 0.01 mass % or more and 0.50 mass % or less, Nb: 0.01 mass % or more and 0.50 mass % or less, V: 0.01 mass % or more and 1.00 mass % or less, W: 0.01 mass % or more and 1.00 mass % or less, Co: 0.01 mass % or more and 1.00 mass % or less, and Sn: 0.01 mass % or more and 1.00 mass % or less.

4. The stainless steel according to claim 2, further comprising at least any one of Cu: 0.1 mass % or more and 4.0 mass % or less, REM: 0.00001 mass % or more and 0.0030 mass % or less, Ca: 0.0001 mass % or more and 0.0050 mass % or less, B: 0.0001 mass % or more and 0.0050 mass % or less, Ti: 0.01 mass % or more and 0.50 mass % or less, Nb: 0.01 mass % or more and 0.50 mass % or less, V: 0.01 mass % or more and 1.00 mass % or less, W: 0.01 mass % or more and 1.00 mass % or less, Co: 0.01 mass % or more and 1.00 mass % or less, and Sn: 0.01 mass % or more and 1.00 mass % or less.

5. A method for producing the stainless steel according to claim 1, the method comprising a refining step of performing refining in VOD or AOD, wherein a slag composition is, in mass % ratio, $CaO/SiO_2$: 1.1 or more and 1.7 or less, $Al_2O_3$: 4.0 mass % or less, and MgO: 10.0 mass % or less by, in the refining step, adjusting an amount of Al and an amount of $Al_2O_3$ contained in a raw material or a ladle, performing deoxidation using a Fe—Si alloy or metal Si, and also adding CaO or $SiO_2$, and moreover stirring molten steel at a stirring power of 50 W/ton or more for 5 minutes or more after adding a refining slag material and an alloy material.

6. A method for producing the stainless steel according to claim 2, the method comprising a refining step of performing refining in VOD or AOD, wherein a slag composition is, in mass % ratio, $CaO/SiO_2$: 1.1 or more and 1.7 or less, $Al_2O_3$: 4.0 mass % or less, and MgO: 10.0 mass % or less by, in the refining step, adjusting an amount of Al and an amount of $Al_2O_3$ contained in a raw material or a ladle, performing deoxidation using a Fe—Si alloy or metal Si, and also adding CaO or $SiO_2$, and moreover stirring molten steel at a stirring power of 50 W/ton or more for 5 minutes or more after adding a refining slag material and an alloy material.

7. A method for producing the stainless steel according to claim 3, the method comprising a refining step of performing refining in VOD or AOD, wherein a slag composition is, in mass % ratio, $CaO/SiO_2$: 1.1 or more and 1.7 or less, $Al_2O_3$: 4.0 mass % or less, and MgO: 10.0 mass % or less by, in the refining step, adjusting an amount of Al and an amount of $Al_2O_3$ contained in a raw material or a ladle, performing deoxidation using a Fe—Si alloy or metal Si, and also adding CaO or $SiO_2$, and moreover stirring molten steel at a stirring power of 50 W/ton or more for 5 minutes or more after adding a refining slag material and an alloy material.

8. A method for producing the stainless steel with according to claim 4, the method comprising a refining step of performing refining in VOD or AOD, wherein a slag composition is, in mass % ratio, $CaO/SiO_2$: 1.1 or more and 1.7 or less, $Al_2O_3$: 4.0 mass % or less, and MgO: 10.0 mass % or less by, in the refining step, adjusting an amount of Al and an amount of $Al_2O_3$ contained in a raw material or a ladle, performing deoxidation using a Fe—Si alloy or metal Si, and also adding CaO or $SiO_2$, and moreover stirring molten steel at a stirring power of 50 W/ton or more for 5 minutes or more after adding a refining slag material and an alloy material.

* * * * *